US010629358B2

(12) United States Patent
Yoshioka et al.

(10) Patent No.: US 10,629,358 B2
(45) Date of Patent: Apr. 21, 2020

(54) COIL COMPONENT

(71) Applicant: Murata Manufacturing Co., Ltd., Kyoto (JP)

(72) Inventors: Yoshimasa Yoshioka, Nagaokakyo (JP); Kenji Nishiyama, Nagaokakyo (JP); Akinori Hamada, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 801 days.

(21) Appl. No.: 15/193,281

(22) Filed: Jun. 27, 2016

(65) Prior Publication Data

US 2016/0379746 A1 Dec. 29, 2016

(30) Foreign Application Priority Data

Jun. 29, 2015 (JP) ..... 2015-130138

(51) Int. Cl.

| | |
|---|---|
| ***H01F 27/255*** | (2006.01) |
| ***H01F 27/28*** | (2006.01) |
| ***H01F 27/38*** | (2006.01) |
| ***H01F 17/00*** | (2006.01) |
| *H01F 17/04* | (2006.01) |

(52) U.S. Cl.

CPC ..... *H01F 27/255* (2013.01); *H01F 17/0013* (2013.01); *H01F 27/2823* (2013.01); *H01F 27/38* (2013.01); *H01F 2017/0093* (2013.01); *H01F 2017/048* (2013.01)

(58) Field of Classification Search

CPC ..... H01F 27/2804; H01F 2027/2809; H01F 27/255; H01F 27/28; H01F 27/38

See application file for complete search history.

(56) References Cited

U.S. PATENT DOCUMENTS

| | | | | |
|---|---|---|---|---|
| 1,530,649 A * | 3/1925 | Casper | H03F 3/02 | 330/189 |
| 1,724,935 A * | 8/1929 | Huet | H01F 38/085 | 336/145 |
| 2,633,561 A * | 3/1953 | Hewlett, Jr. | H01F 38/04 | 363/140 |
| 3,171,092 A * | 2/1965 | Jetter | H01F 29/14 | 336/155 |
| 3,237,090 A * | 2/1966 | Royer | H01F 38/085 | 323/340 |
| 4,107,635 A * | 8/1978 | Brundage | H01F 29/10 | 336/133 |
| 4,858,095 A * | 8/1989 | Narita | H03B 9/10 | 363/21.04 |

(Continued)

FOREIGN PATENT DOCUMENTS

JP 2002075756 A * 3/2002

*Primary Examiner* — Elvin G Enad
*Assistant Examiner* — Malcolm Barnes
(74) *Attorney, Agent, or Firm* — Studebaker & Brackett PC

(57) ABSTRACT

A coil component includes a core with a closed magnetic circuit structure, a primary-side coil wound around the core, and a secondary-side coil wound around the core, disposed in an axial direction of the primary-side coil, and magnetically coupled to the primary-side coil. The primary-side coil and the secondary-side coil each include a first coil portion, and a second coil portion electrically connected to the first coil portion. The second coil portion overlaps in an axial direction of the first coil portion and an axis of the second coil portion is eccentric from an axis of the first coil portion. A cross-sectional area of an inner magnetic path of the second coil portion in a direction orthogonal to the axis is smaller than a cross-sectional area of an inner magnetic path of the first coil portion in a direction orthogonal to the axis.

14 Claims, 13 Drawing Sheets

(56) References Cited

U.S. PATENT DOCUMENTS

| | | | | |
|---|---|---|---|---|
| 5,481,238 | A * | 1/1996 | Carsten | G05F 1/24 323/259 |
| 5,546,065 | A * | 8/1996 | Vinciarelli | H01F 27/346 336/212 |
| 6,362,986 | B1 | 3/2002 | Schultz et al. | |
| 6,807,069 | B2 * | 10/2004 | Nieminen | H02M 3/33561 363/17 |
| 2004/0189432 | A1 * | 9/2004 | Yan | H01F 27/38 336/182 |
| 2005/0219031 | A1 * | 10/2005 | Sokolov | H01F 30/04 336/212 |
| 2008/0079525 | A1 * | 4/2008 | Sundaram | H01F 27/289 336/182 |
| 2009/0230776 | A1 * | 9/2009 | Ochi | H01F 19/00 307/83 |
| 2010/0066474 | A1 * | 3/2010 | Huang | H01F 27/289 336/73 |
| 2010/0103585 | A1 * | 4/2010 | Mao | H01F 27/28 361/270 |
| 2012/0326827 | A1 * | 12/2012 | Nanjyo | H01F 17/0033 336/200 |
| 2013/0154783 | A1 * | 6/2013 | Kato | H01F 27/2804 336/200 |
| 2014/0016369 | A1 * | 1/2014 | Chandrasekaran | H01F 3/10 363/21.12 |
| 2016/0078986 | A1 * | 3/2016 | Yoon | H01F 5/04 336/83 |
| 2017/0170800 | A1 * | 6/2017 | Saito | H01F 19/06 |

* cited by examiner

COIL COMPONENT

CROSS REFERENCE TO RELATED APPLICATIONS

This application claims benefit of priority to Japanese Patent Application 2015-130138 filed Jun. 29, 2015, the entire content of which is incorporated herein by reference.

TECHNICAL FIELD

The present disclosure relates to a coil component.

BACKGROUND

Conventional coil components include a coil component described in U.S. Pat. No. 6,362,986. This coil component has a core with an open magnetic circuit structure, a primary-side coil wound around the core, and a secondary-side coil wound around the core and magnetically coupled to the primary-side coil. The inner magnetic path of the primary-side coil and the inner magnetic path of the secondary-side coil are arranged on the same straight line or are arranged on non-collinear straight lines.

SUMMARY

Problem to be Solved by the Disclosure

It was found out that the following problem exists when the conventional coil component is actually used. When the inner magnetic path of the primary-side coil and the inner magnetic path of the secondary-side coil are arranged on the same straight line, a coupling coefficient becomes extremely high, which makes it difficult to acquire a desired coupling coefficient (K). On the other hand, when the inner magnetic path of the primary-side coil and the inner magnetic path of the secondary-side coil are arranged on non-collinear straight lines, the coupling coefficient becomes extremely low, which makes it difficult to acquire the desired coupling coefficient. Since the core has the open magnetic circuit structure, an inductance (L) decreases.

Therefore, a problem to be solved by the present disclosure is to provide a coil component capable of increasing an inductance and adjusting a coupling coefficient.

Solutions to the Problems

To solve the problem, a coil component of the present disclosure is a coil component comprising:

a core with a closed magnetic circuit structure;

a primary-side coil wound around the core; and a secondary-side coil wound around the core, disposed in an axial direction of the primary-side coil, and magnetically coupled to the primary-side coil, wherein the primary-side coil and the secondary-side coil each include a first coil portion, and a second coil portion electrically connected to the first coil portion, wherein the second coil portion overlaps in an axial direction of the first coil portion, wherein an axis of the second coil portion is eccentric from an axis of the first coil portion, and wherein a cross-sectional area of an inner magnetic path of the second coil portion in a direction orthogonal to the axis is smaller than a cross-sectional area of an inner magnetic path of the first coil portion in a direction orthogonal to the axis.

The inner magnetic paths of the coil portions are magnetic paths formed by the core in hole portions of the coil portions.

According to the coil component of the present disclosure, since the core with the primary-side coil and the secondary-side coil wound therearound has the closed magnetic circuit structure, the inductance can be increased.

The primary-side coil and the secondary-side coil each include the first coil portion and the second coil portion; the second coil portion overlaps in the axial direction of the first coil portion; the axis of the second coil portion is eccentric from the axis of the first coil portion; and the cross-sectional area of the inner magnetic path of the second coil portion is smaller than the cross-sectional area of the inner magnetic path of the first coil portion. As a result, an overlapping region can be adjusted between the inner magnetic path of the primary-side coil and the inner magnetic path of the secondary-side coil viewed in the axial direction of the primary-side coil, so that the coupling coefficient can be adjusted.

In an embodiment of the coil component, when viewed in the axial direction of the primary-side coil, the inner magnetic path of the first coil portion of the primary-side coil overlaps with the inner magnetic path of the first coil portion of the secondary-side coil, while the inner magnetic path of the second coil portion of the primary-side coil does not overlap with the inner magnetic path of the second coil portion of the secondary-side coil.

According to the embodiment, when viewed in the axial direction of the primary-side coil, the inner magnetic path of the first coil portion of the primary-side coil overlaps with the inner magnetic path of the first coil portion of the secondary-side coil, while the inner magnetic path of the second coil portion of the primary-side coil does not overlap with the inner magnetic path of the second coil portion of the secondary-side coil. As a result, an axial overlapping region can easily be adjusted between the inner magnetic path of the primary-side coil and the inner magnetic path of the secondary-side coil, so that the coupling coefficient can easily be adjusted.

In an embodiment of the coil component, the second coil portion of the primary-side coil and the second coil portion of the secondary-side coil are arranged in parallel in the direction orthogonal to the axis of the primary-side coil.

According to the embodiment, since the second coil portion of the primary-side coil and the second coil portion of the secondary-side coil are arranged in parallel in the direction orthogonal to the axis of the primary-side coil, the coil component can be reduced in size in the axial direction of the primary-side coil, so that the miniaturization of the coil component can be achieved.

In an embodiment of the coil component, a cross-sectional area of a conductor of the first coil portion is different from a cross-sectional area of a conductor of the second coil portion.

According to the embodiment, since the cross-sectional area of the conductor of the first coil portion is different from the cross-sectional area of the conductor of the second coil portion, the coil component with higher performance, for example, lower resistance, can be achieved.

In an embodiment of the coil component, a pitch of the conductor of the second coil portion is narrower than a pitch of the conductor of the first coil portion.

According to the embodiment, since the pitch of the conductor of the second coil portion is narrower than the pitch of the conductor of the first coil portion, the cross-sectional area of the inner magnetic path of the second coil portion can be ensured.

In an embodiment of the coil component, an aspect ratio of the conductor of the second coil portion is larger than an aspect ratio of the conductor of the first coil portion.

According to the embodiment, since the aspect ratio of the conductor of the second coil portion is larger than the aspect ratio of the conductor of the first coil portion, the cross-sectional area of the inner magnetic path of the second coil portion can further be ensured.

In an embodiment of the coil component, the core is made of an organic resin containing a magnetic material and has a magnetic permeability of 40 or less.

According to the embodiment, even when the core is made of a material with low magnetic permeability, a desired coupling coefficient can be acquired.

Effect of the Disclosure

According to the coil component of the present disclosure, the inductance can be increased and the coupling coefficient can be adjusted.

DETAILED DESCRIPTION

The present disclosure will now be described in detail with shown embodiments.

First Embodiment

Figure 1:
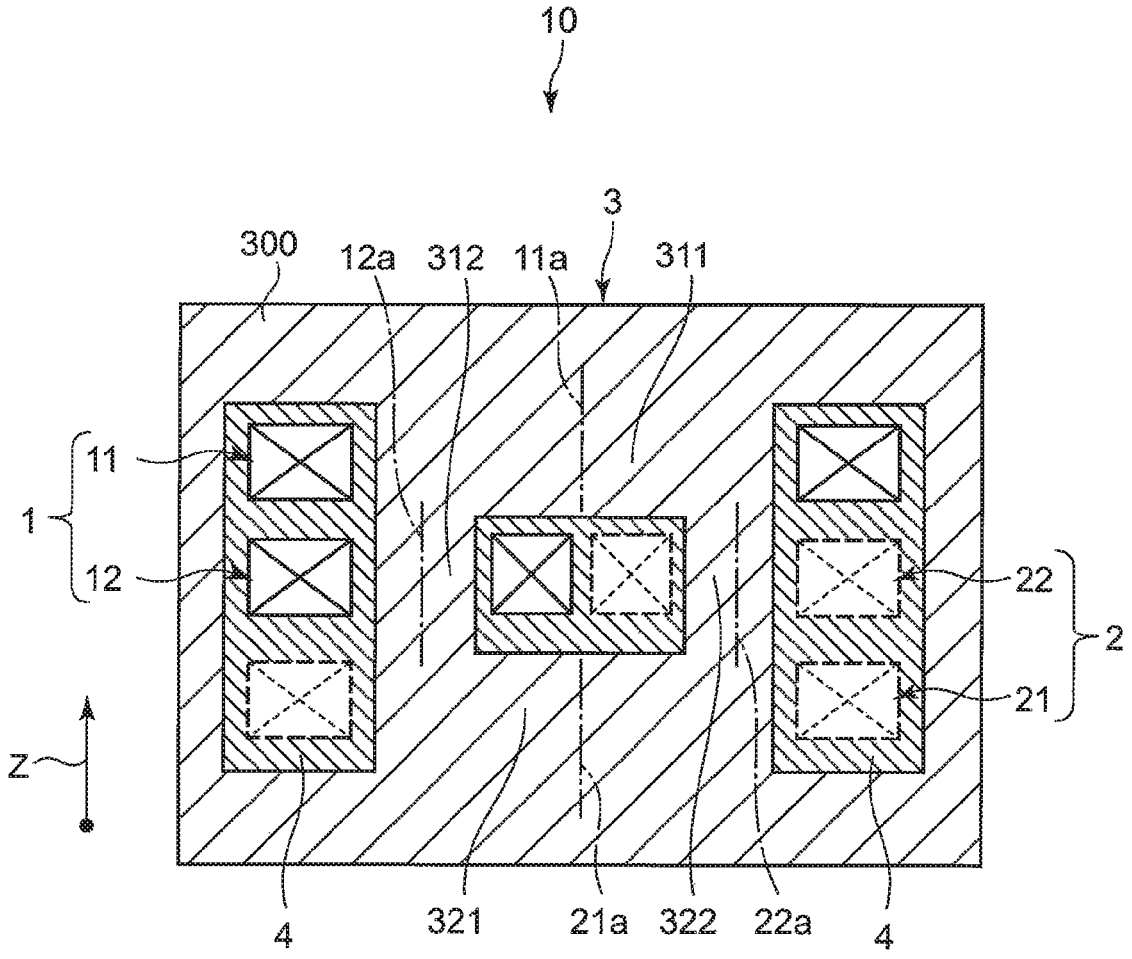
FIG. 1 is a cross-sectional view of a first embodiment of a coil component of the present disclosure.
Figure 2:
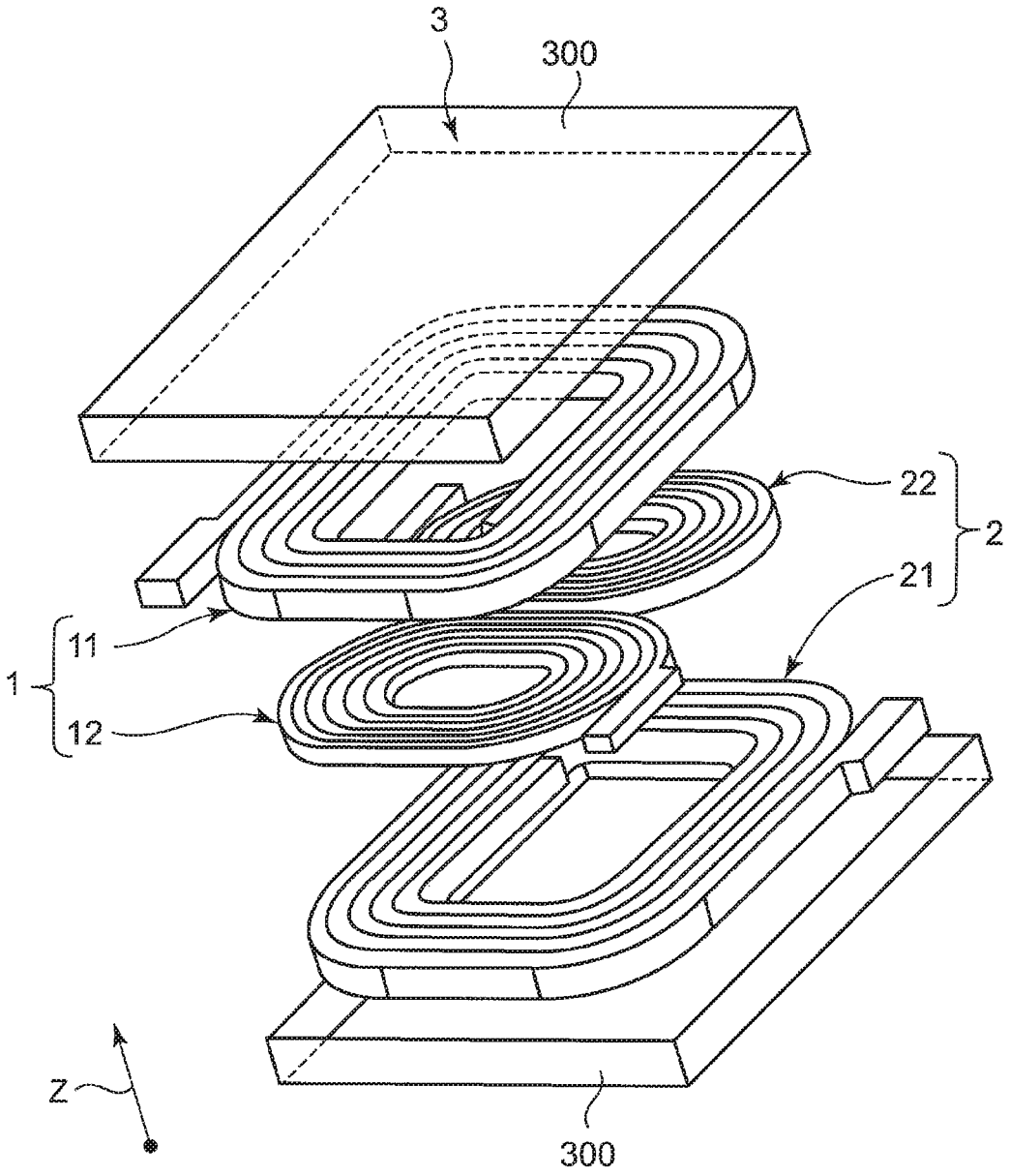
FIG. 2 is an exploded perspective view of the coil component.

FIG. 1 is a cross-sectional view of a first embodiment of a coil component of the present disclosure. FIG. 2 is an exploded perspective view of the coil component. As shown in FIGS. 1 and 2, a coil component 10 has a core 3 with a closed magnetic circuit structure, a primary-side coil 1 wound around the core 3, and a secondary-side coil 2 wound around the core 3, disposed in an axial direction of the primary-side coil 1, and magnetically coupled to the primary-side coil 1. The coil component 10 is used as a power choke coil, for example. The primary-side coil 1 and the secondary-side coil 2 are covered with an insulation resin 4. The insulation resin 4 is covered with the core 3. The axial direction of the primary-side coil 1 is defined as a Z-axial direction. In FIG. 1, the primary-side coil 1 is depicted by solid lines and the secondary-side coil 2 is depicted by dashed lines.

The primary-side coil 1 has a first coil portion 11, and a second coil portion 12 electrically connected to the first coil portion 11. The first coil portion 11 is connected to the second coil portion 12 through a via conductor extending in the Z-axial direction. The first and second coil portions 11, 12 are each formed into a plane spiral shape. The first and second coil portions 11, 12 each include a conductor and an insulation resin covering the conductor.

The conductors are made of low-resistance metal, for example, Cu, Ag, and Au. Preferably, low-resistance and narrow-pitch coils can be formed by applying Cu plating formed by a semi-additive process to the conductors.

The material of the insulation resin is, for example, a single material that is an organic insulation material made of epoxy-based resin, bismaleimide, liquid crystal polymer, polyimide, etc., or is an insulation material comprising a combination with an inorganic filler material such as a silica filler and an organic filler made of a rubber material. In this embodiment, the insulation resin is made of an epoxy resin containing a silica filler.

The second coil portion 12 overlaps in a direction of an axis 11*a* of the first coil portion 11. An axis 12*a* of the second coil portion 12 is eccentric from the axis 11*a* of the first coil portion 11. The axis 11*a* of the first coil portion 11 is in parallel with the axis 12*a* of the second coil portion 12.

An inner magnetic path 311 is formed in a hole portion of the first coil portion 11. The inner magnetic path 311 of the first coil portion 11 is a magnetic path formed by the core 3 in the hole portion of the first coil portion 11. Similarly, an inner magnetic path 312 is formed in a hole portion of the second coil portion 12.

Figure 3:
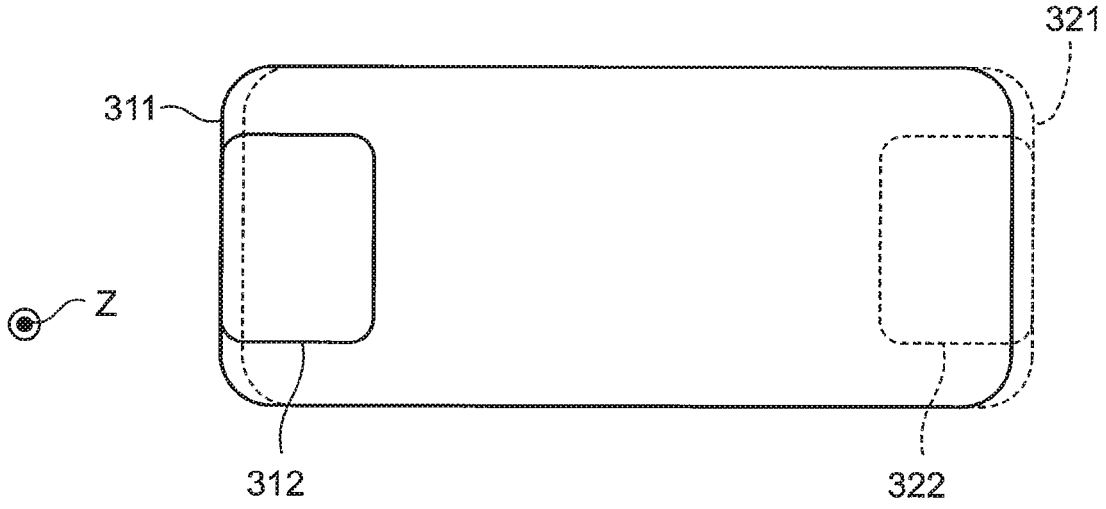
FIG. 3 is a plane view of an inner magnetic path.

As shown in FIG. 3, a cross-sectional area of the inner magnetic path 312 of the second coil portion 12 in the direction orthogonal to the axis 12*a* of the second coil portion 12 is smaller than a cross-sectional area of the inner magnetic path 311 of the first coil portion 11 in the direction orthogonal to the axis 11*a* of the first coil portion 11. When viewed in the Z-axial direction, the whole of the inner magnetic path 312 of the second coil portion 12 overlaps with the inner magnetic path 311 of the first coil portion 11.

As shown in FIGS. 1 to 3, the secondary-side coil 2 has a first coil portion 21 and a second coil portion 22 as is the case with the primary-side coil 1. The second coil portion 22 overlaps in a direction of an axis 21*a* of the first coil portion 21. An axis 22*a* of the second coil portion 22 is eccentric from the axis 21*a* of the first coil portion 21. The axis 21*a* of the first coil portion 21 is in parallel with the axis 22*a* of the second coil portion 22. An inner magnetic path 321 is formed in a hole portion of the first coil portion 21. An inner magnetic path 322 is formed in a hole portion of the second coil portion 22.

A cross-sectional area of the inner magnetic path 322 of the second coil portion 22 in the direction orthogonal to the axis 22*a* of the second coil portion 22 is smaller than a cross-sectional area of the inner magnetic path 321 of the first coil portion 21 in the direction orthogonal to the axis 21*a* of the first coil portion 21. When viewed in the Z-axial direction, the whole of the inner magnetic path 322 of the second coil portion 22 overlaps with the inner magnetic path 321 of the first coil portion 21.

When viewed in the axial direction of the primary-side coil 1 (the Z-axial direction), the inner magnetic path 311 of the first coil portion 11 of the primary-side coil 1 overlaps with the inner magnetic path 321 of the first coil portion 21 of the secondary-side coil 2, while the inner magnetic path 312 of the second coil portion 12 of the primary-side coil 1 does not overlap with the inner magnetic path 322 of the second coil portion 22 of the secondary-side coil 2.

The inner magnetic paths 311, 321 of the first coil portions 11, 21 are approximately rectangular and approximately the same size. The inner magnetic paths 312, 322 of the second coil portions 12, 22 are approximately rectangular and approximately the same size. The inner magnetic paths 311, 321 of the first coil portions 11, 21 are larger than the inner magnetic paths 312, 322 of the second coil portions 12, 22.

The inner magnetic paths 311, 321 of the first coil portions 11, 21 are substantially coincident and overlap with each other. The inner magnetic path 312 of the second coil portion 12 is disposed inside one of the short sides of the inner magnetic paths 311, 321 of the first coil portions 11, 21. The inner magnetic path 322 of the second coil portion 22 is disposed inside the other short side of the inner magnetic paths 311, 321 of the first coil portions 11, 21.

The second coil portion 12 of the primary-side coil 1 and the second coil portion 22 of the secondary-side coil 2 are arranged in parallel in the direction orthogonal to the axis (Z-axis) of the primary-side coil 1. Since the second coil portion 12 of the primary-side coil 1 and the second coil portion 22 of the secondary-side coil 2 have a plane spiral shape, they are therefore arranged on the same plane.

The primary-side coil 1 and the secondary-side coil 2 are equalized in the number of turns, coil length, coil inner diameter, etc., in approximately rotationally symmetric arrangement so that individual impedances become equal.

The primary-side coil 1 and the secondary-side coil 2 are coated outside with the core 3 and the core 3 makes up an outer magnetic path 300. The outer magnetic path 300 and the inner magnetic paths 311, 312, 321, 322 are coupled and the core 3 makes up a closed magnetic circuit structure.

The material of the core 3 is, for example, a resin material containing magnetic powder. The magnetic powder is, for example, a metal magnetic material such as Fe, Si, and Cr and the resin material is, for example, a resin material such as epoxy. For improvement of the characteristics of the coil component 10 (L-value and superposition characteristics), it is desirable to contain the magnetic powder at 90 wt % or more and, for improvement of a filling property of the core 3, it is more desirable to mix two or more types of magnetic powder different in particle size distribution. When the use of the coil component is associated with a high usage frequency, for example, 40 MHz or more, the core 3 may be made of a material with a dispersed single magnetic filler having a particle size distribution of 1 μm or less. In this embodiment, the core 3 is made of an organic resin containing a magnetic material and has a magnetic permeability of 40 or less.

The insulation resin 4 is made of the same material as the insulation resin of the coil portions 11, 12, 21, 22. In this embodiment, the insulation resin 4 is made of an epoxy resin containing a silica filler.

According to the coil component 10, since the core 3 with the primary-side coil 1 and the secondary-side coil 2 wound therearound has a closed magnetic circuit structure, the inductance can be increased. Additionally, a leaking magnetic flux to the outside can be reduced to suppress interference with an external circuit.

The primary-side coil 1 and the secondary-side coil 2 respectively have the first coil portions 11, 21 and the second coil portions 12, 22; the second coil portions 12, 22 overlap in the axial direction of the first coil portions 11, 21; the axes of the second coil portions 12, 22 are eccentric from the axes of the first coil portions 11, 21; and the cross-sectional areas of the inner magnetic paths 312, 322 of the second coil portions 12, 22 are smaller than the cross-sectional areas of the inner magnetic paths 311, 321 of the first coil portions 11, 21. As a result, overlapping regions can be adjusted between the inner magnetic paths 311, 312 of the primary-side coil 1 and the inner magnetic paths 321, 322 of the secondary-side coil 2 viewed in the axial direction of the primary-side coil 1, so that the coupling coefficient can be adjusted. Additionally, by adjusting the coupling coefficient, a ripple current can be reduced to improve energy efficiency.

According to the coil component 10, when viewed in the axial direction of the primary-side coil 1, the inner magnetic path of the first coil portion 11 of the primary-side coil 1 overlaps with the inner magnetic path of the first coil portion 21 of the secondary-side coil 2, while the inner magnetic path of the second coil portion 12 of the primary-side coil 1 does not overlap with the inner magnetic path of the second coil portion 22 of the secondary-side coil 2. As a result, an axial overlapping region can easily be adjusted between the inner magnetic paths 311, 321 of the primary-side coil 1 and the inner magnetic paths 321, 322 of the secondary-side coil 2, so that the coupling coefficient can easily be adjusted.

According to the coil component 10, since the second coil portion 12 of the primary-side coil 1 and the second coil portion 22 of the secondary-side coil 2 are arranged in parallel in the direction orthogonal to the axis of primary-side coil 1, the coil component 10 can be reduced in size in the axial direction of the primary-side coil 1, so that the miniaturization of the coil component 10 can be achieved.

According to the coil component 10, since the core 3 is made of an organic resin containing a magnetic material and has a magnetic permeability of 40 or less, even when the core 3 is made of a material with low magnetic permeability, a desired coupling coefficient can be acquired.

Second Embodiment

Figure 4:
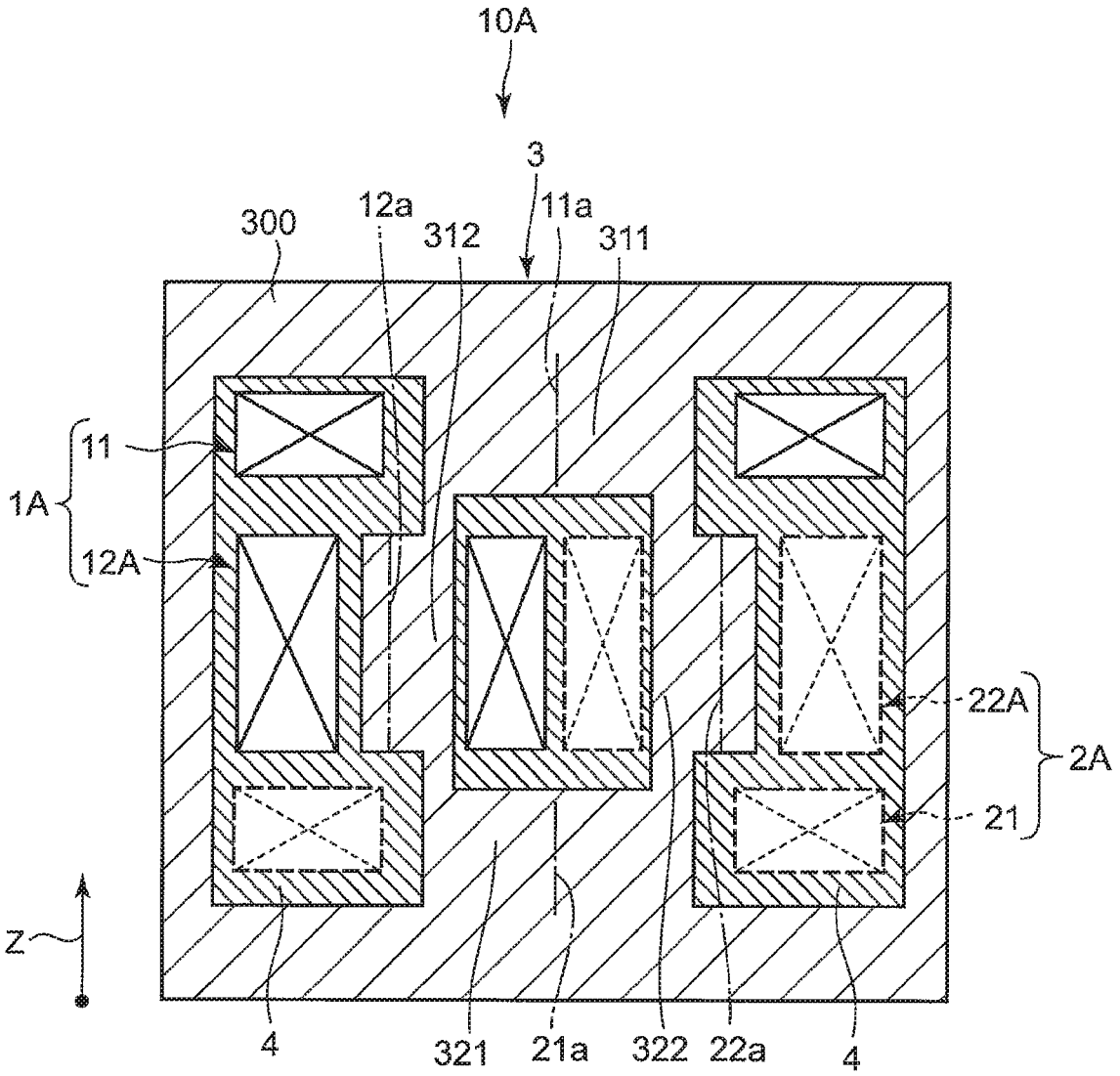
FIG. 4 is a cross-sectional view of a second embodiment of the coil component of the present disclosure.
Figure 5:
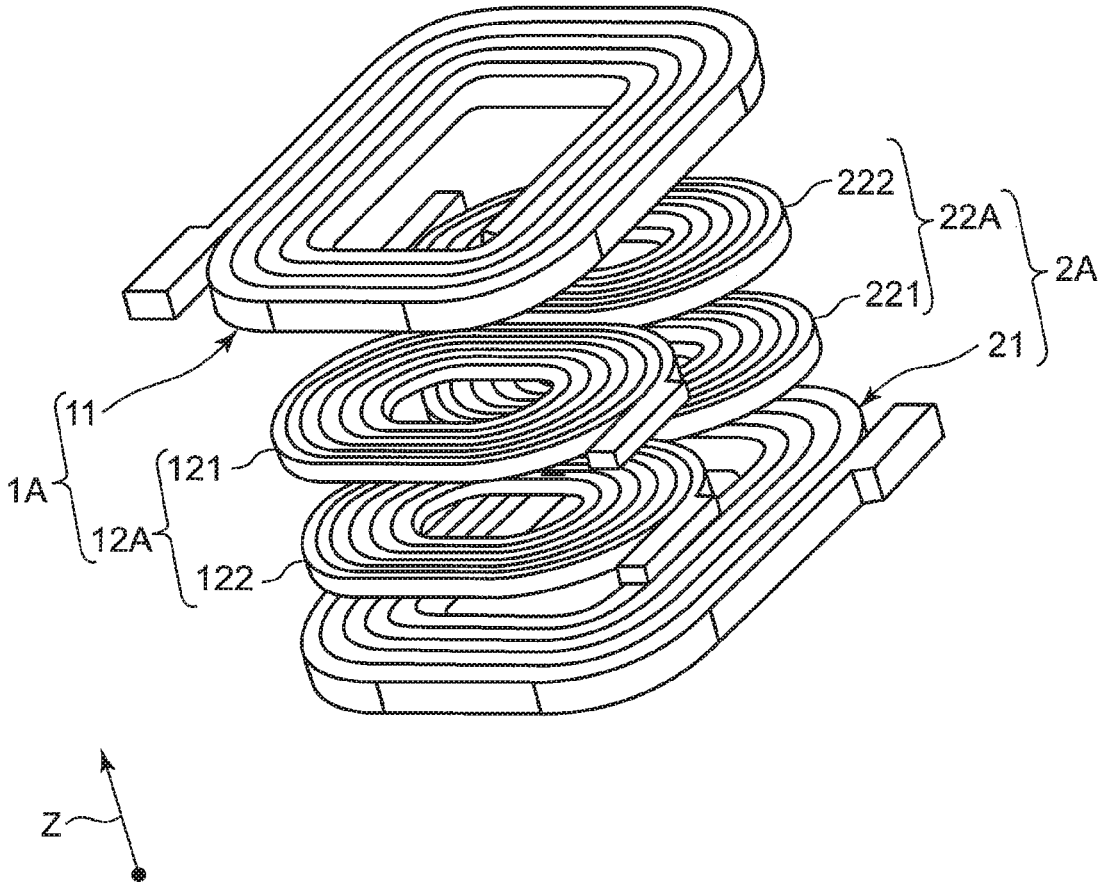
FIG. 5 is an exploded perspective view of the coil component.

FIG. 4 is a cross-sectional view of a second embodiment of the coil component of the present disclosure. FIG. 5 is an exploded perspective view of the coil component. The second embodiment is different from the first embodiment in configuration of the second coil portions of the primary-side coil and the secondary-side coil. Only this different configuration will hereinafter be described. In the second embodiment, the same constituent elements as the first embodiment are denoted by the same reference numerals as the first embodiment and therefore will not be described.

As shown in FIGS. 4 and 5, in a coil component 10A, a second coil portion 12A of a primary-side coil 1A has a first spiral portion 121 and a second spiral portion 122. The first and second spiral portions 121, 122 are laminated in order from the first coil portion 11 in the Z-axial direction. The first and second spiral portions 121, 122 are connected through a via conductor extending in the Z-axial direction. The first and second spiral portions 121, 122 are formed into a plane spiral shape. The first and second spiral portions 121, 122 have the same shape when viewed in the Z-axial direction. The first and second spiral portions 121, 122 each include a conductor and an insulation resin covering the conductor. The first and second spiral portions 121, 122 are electrically connected in parallel so that a direct current resistance of the first and second spiral portions 121, 122 is made lower.

A second coil portion 22A of a secondary-side coil 2A has a first spiral portion 221 and a second spiral portion 222 as is the case with the second coil portion 12A of the primary-side coil 1A. The first and second spiral portions 221, 222 of the secondary-side coil 2A are the same as the first and second spiral portions 121, 122 of the primary-side coil 1A and therefore will not be described.

In a cross section of the primary-side coil 1A in the axial direction, a cross-sectional area of the conductors of the first coil portions 11, 21 may be different from a cross-sectional area of the conductors of the second coil portions 12A, 22A. Therefore, as a result, the coil component 10A with higher performance, for example, lower resistance, can be achieved.

A pitch of the conductors of the second coil portions 12A, 22A may be made narrower than a pitch of the conductors of the first coil portions 11, 21. As a result, the cross-sectional area of the inner magnetic paths 312, 322 of the second coil portions 12A, 22A can be ensured.

An aspect ratio of the conductors of the second coil portions 12A, 22A may be larger than an aspect ratio of the conductors of the first coil portions 11, 21. In this case, an aspect ratio of a conductor is a value acquired in a cross section of the conductor in the Z-axial direction by dividing the height in the Z-axial direction by the width in the direction orthogonal to the Z-axial direction. As a result, the cross-sectional area of the inner magnetic paths 312, 322 of the second coil portions 12A, 22A can further be ensured. In particular, by narrowing the width of the conductors of the second coil portions 12A, 22A, the cross-sectional area of the inner magnetic paths 312, 322 can be made larger to make the inductance larger. On the other hand, by widening the width and lowering the height of the conductors of the first coil portions 11, 21, the magnetic resistance of the inner magnetic paths 311, 321 of the first coil portions 11, 21 can be reduced to make the inductance larger and the direct current resistance lower.

According to the coil component 10A, since the second coil portion 12A and the primary-side coil 1A and the second coil portion 22A of the secondary-side coil 2A are each made up of the two spiral portions 121, 122, 221, 222, a degree of freedom is increased in the design of the coil component 10A.

Third Embodiment

Figure 6:
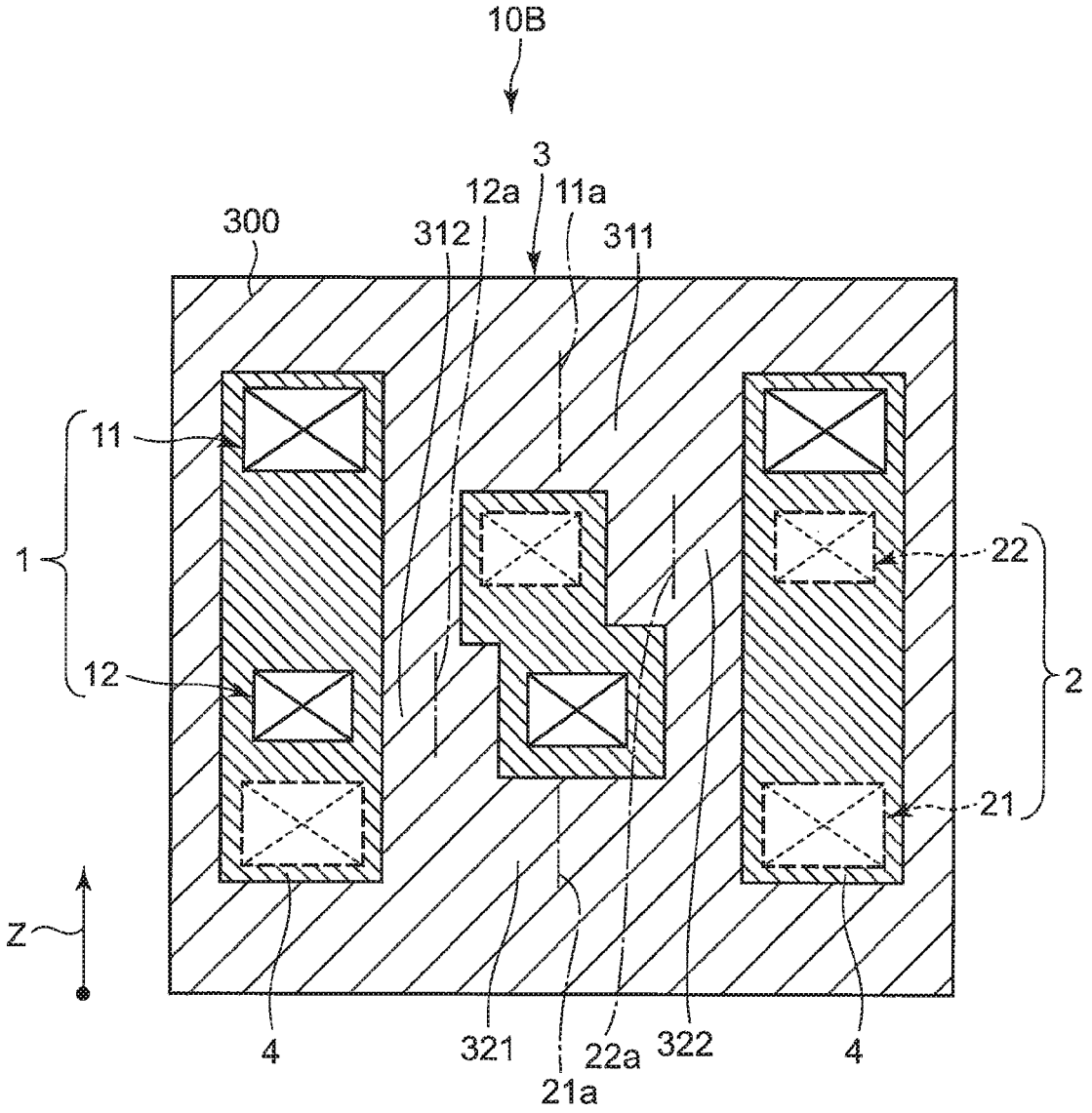
FIG. 6 is a cross-sectional view of a third embodiment of the coil component of the present disclosure.

FIG. 6 is a cross-sectional view of a third embodiment of the coil component of the present disclosure. The third embodiment is different from the first embodiment in positions of the second coil portions of the primary-side coil and the secondary-side coil. Only this different configuration will hereinafter be described. In the third embodiment, the same constituent elements as the first embodiment are denoted by the same reference numerals as the first embodiment and therefore will not be described.

As shown in FIG. 6, in a coil component 10B, the second coil portion 12 of the primary-side coil 1 and the second coil portion 22 of the secondary-side coil 2 are located in the Z-axial direction. In the Z-axial direction, the second coil portion 12 of the primary-side coil 1 is located between the first coil portion 21 and the second coil portion 22 of the secondary-side coil 2, and the second coil portion 22 of the secondary-side coil 2 is located between the first coil portion 11 and the second coil portion 12 of the primary-side coil 1. The inner magnetic path 312 of the second coil portion 12 of the primary-side coil 1 does not overlap with the inner magnetic path 322 of the second coil portion 22 of the secondary-side coil 2 in the Z-axial direction.

According to the coil component 10B, since the second coil portion 12 of the primary-side coil 1 and the second coil portion 22 of the secondary-side coil 2 are shifted in the Z-axial direction, the inner magnetic paths 312, 322 of the second coil portions 12, 22 can be made larger in diameter (size in the direction orthogonal to the Z-axis) to increase the inductance.

The present disclosure is not limited to the embodiments and may be changed in design without departing from the spirit of the present disclosure. For example, respective feature points of the first to third embodiments may variously be combined.

Although the primary-side and secondary-side coils are respectively defined as the first and second coil portions in the embodiments, three or more coil portions may be used.

Although the first and second coil portions are formed into a plane spiral shape in the embodiments, the coil portions may be formed into a cylindrical spiral shape.

EXAMPLE

Figure 7:
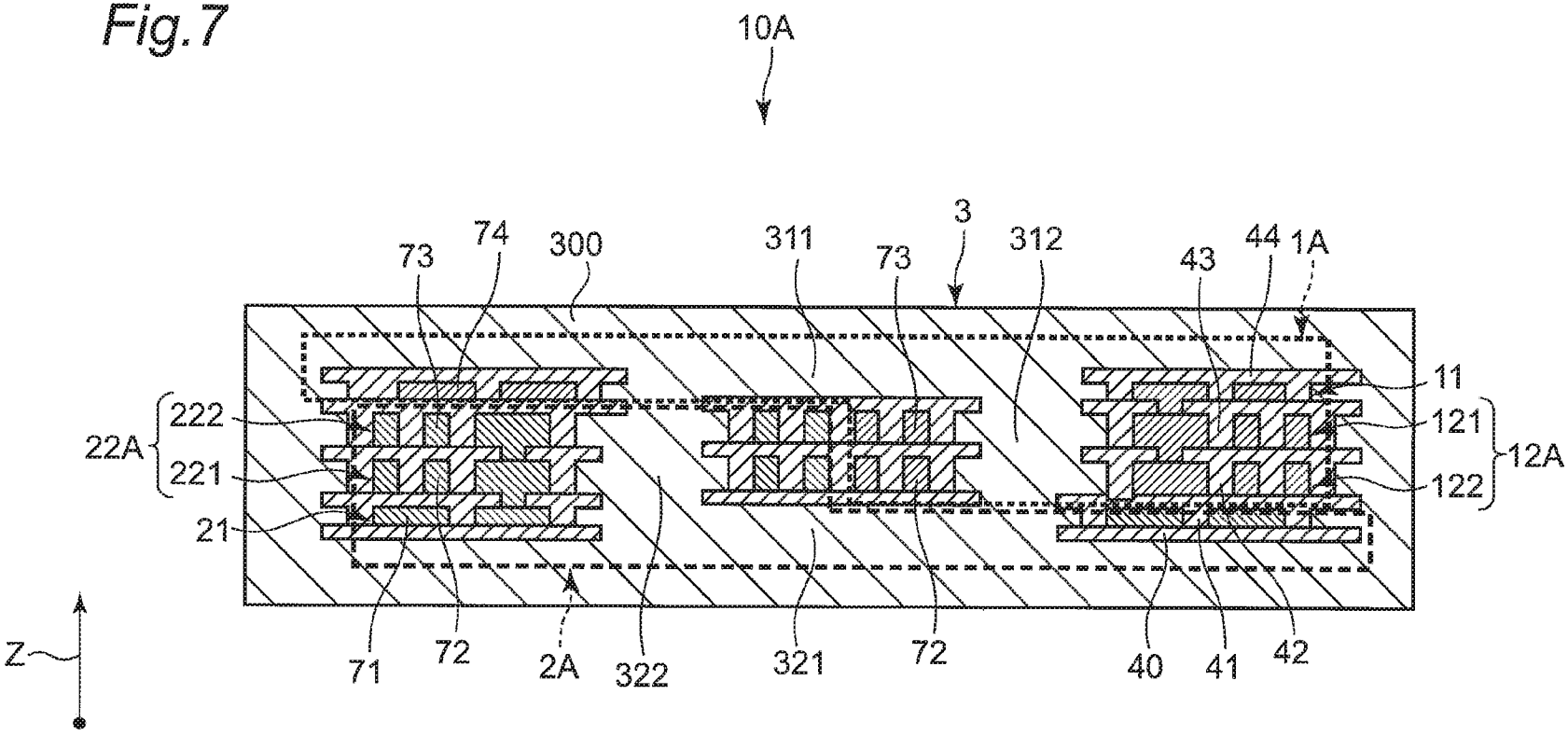
FIG. 7 is a cross-sectional view of an example of the second embodiment.

FIG. 7 is a cross-sectional view of an example of the second embodiment of the coil component of the present disclosure. In the example, the same constituent elements as the second embodiment are denoted by the same reference numerals as the second embodiment and therefore will not be described.

As shown in FIG. 7, the coil component 10A has the base insulation resin 40 and first to fourth insulation resins 41 to 44 as well as first to fourth spiral conductors 71 to 74.

The first spiral conductor 71 is laminated on the base insulation resin 40. The first insulation resin 41 is laminated on the first spiral conductor 71 and the first spiral conductor 71 is covered with the first insulation resin 41.

On the first insulation resin 41, the two second spiral conductors 72 are laminated in parallel. The second insulation resin 42 is laminated on the second spiral conductors 72 and the second spiral conductors 72 are covered with the second insulation resin 42.

On the second insulation resin 42, the two third spiral conductors 73 are laminated in parallel. The third insulation resin 43 is laminated on the third spiral conductors 73 and the third spiral conductors 73 are covered by the third insulation resin 43.

The fourth spiral conductor 74 is laminated on the third insulation resin 43. The fourth insulation resin 44 is laminated on the fourth spiral conductor 74 and the fourth spiral conductor 74 is covered with the fourth insulation resin 44.

In the primary-side coil 1A, the first coil portion 11 includes the fourth spiral conductor 74 and the fourth insulation resin 44. The first spiral portion 121 of the second coil portion 12A includes one of the third spiral conductors 73 and the third insulation resin 43. The second spiral portion 122 of the second coil portion 12A includes one of the second spiral conductors 72 and the second insulation resin 42. The fourth spiral conductor 74, the one third spiral conductor 73, and the one second spiral conductor 72 are connected through a via conductor.

In the secondary-side coil 2A, the first coil portion 21 includes the base insulation resin 40, the first spiral conductor 71, and the first insulation resin 41. The first spiral portion 221 of the second coil portion 22A includes the other second spiral conductor 72 and the second insulation resin 42. The second spiral portion 222 of the second coil portion 22A includes the other third spiral conductor 73 and the third insulation resin 43. The first spiral conductor 71, the other second spiral conductor 72, and the other third spiral conductor 73 are connected through a via conductor.

A method of manufacturing the coil component 10A will be described.

Figure 8A:
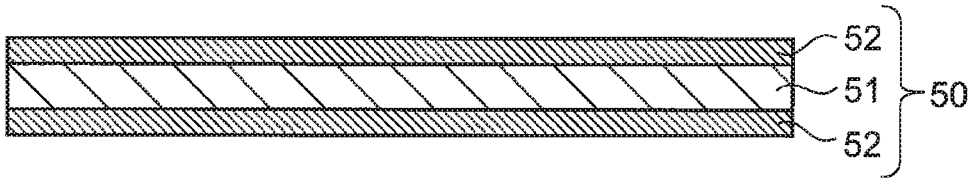
FIG. 8A is an explanatory view for explaining a manufacturing method of the example of the second embodiment.

As shown in FIG. 8A, a base 50 is prepared. The base 50 has an insulation substrate 51 and base metal layers 52 disposed on both sides of the insulation substrate 51. In this embodiment, the insulation substrate 51 is a glass epoxy substrate and the base metal layers 52 are Cu foils.

Figure 8B:
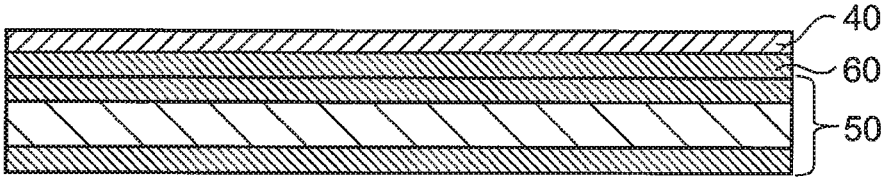
FIG. 8B is an explanatory view for explaining the manufacturing method of the example of the second embodiment.

As shown in FIG. 8B, a dummy metal layer 60 is bonded onto a surface of the base 50. In this embodiment, the dummy metal layer 60 is a Cu foil. Since the dummy metal layer 60 is bonded to the base metal layer 52 of the base 50, the dummy metal layer 60 is bonded to a smooth surface of the base metal layer 52. Therefore, an adhesion force can be made weak between the dummy metal layer 60 and the base metal layer 52 and, at a subsequent step, the base 50 can easily be peeled off from the dummy metal layer 60. Preferably, an adhesive bonding the base 50 and the dummy metal layer 60 is an adhesive with low tackiness. For weakening of the adhesion force between the base 50 and the dummy metal layer 60, it is desirable that the bonding surfaces of the base 50 and the dummy metal layer 60 are glossy surfaces.

Subsequently, the base insulation resin 40 is laminated on the dummy metal layer 60 temporarily bonded to the base 50. In this case, the base insulation resin 40 is laminated by a vacuum laminator and is then thermally cured.

Figure 8C:
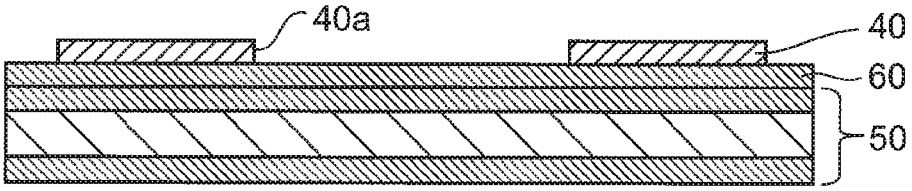
FIG. 8C is an explanatory view for explaining the manufacturing method of the example of the second embodiment.

As shown in FIG. 8C, a through-hole 40*a* is formed in the base insulation resin 40 by laser machining etc. The through-hole 40*a* corresponds to the inner magnetic path 321.

Figure 8D:
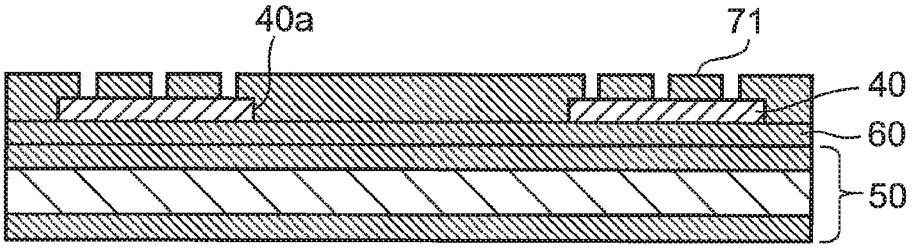
FIG. 8D is an explanatory view for explaining the manufacturing method of the example of the second embodiment.

As shown in FIG. 8D, the first spiral conductor 71 is formed on the base insulation resin 40 by the SAP (semi additive process). In this case, an excess conductor layer is formed concurrently with the first spiral conductor 71.

Figure 8E:
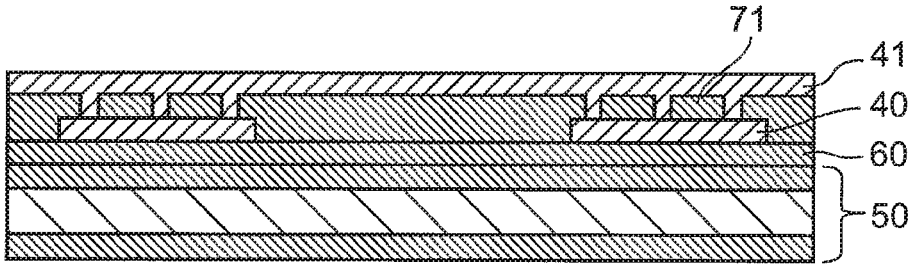
FIG. 8E is an explanatory view for explaining the manufacturing method of the example of the second embodiment.

As shown in FIG. 8E, the first insulation resin 41 is laminated on the first spiral conductor 71 by a vacuum laminator and is then thermally cured.

Figure 8F:
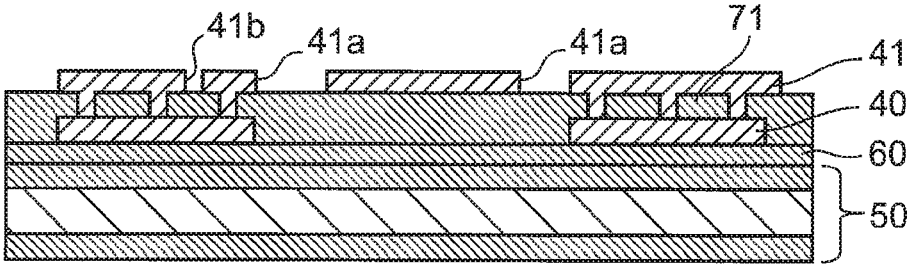
FIG. 8F is an explanatory view for explaining the manufacturing method of the example of the second embodiment.

As shown in FIG. 8F, through-holes 41*a* and a via hole 41*b* are formed in the first insulation resin 41 by laser machining. The through-holes 41*a* correspond to the inner magnetic paths 312, 322. In the via hole 41*b*, a via conductor is formed. By forming the through-holes 41*a* and the via hole 41*b* at the same time, a process can be simplified.

Figure 8G:
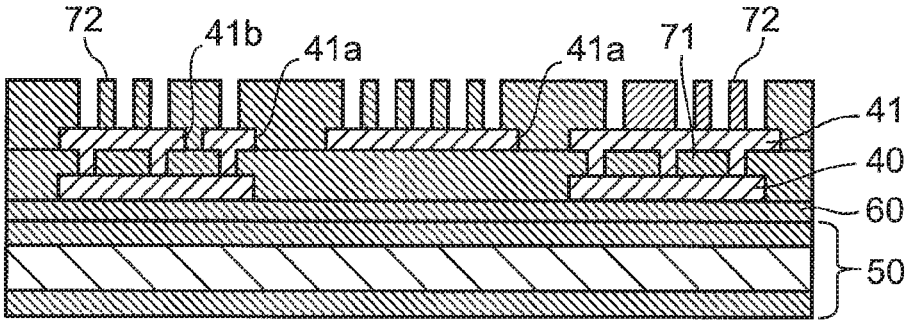
FIG. 8G is an explanatory view for explaining the manufacturing method of the example of the second embodiment.

As shown in FIG. 8G, the two second spiral conductors 72 are formed in parallel on the first insulation resin 41 by the SAP (semi additive process). In this case, one of the second spiral conductors 72 (on the left side of FIG. 8G) is connected through the via conductor to the first spiral conductor 71. In this case, an excess conductor layer is formed concurrently with the second spiral conductors 72.

Figure 8H:
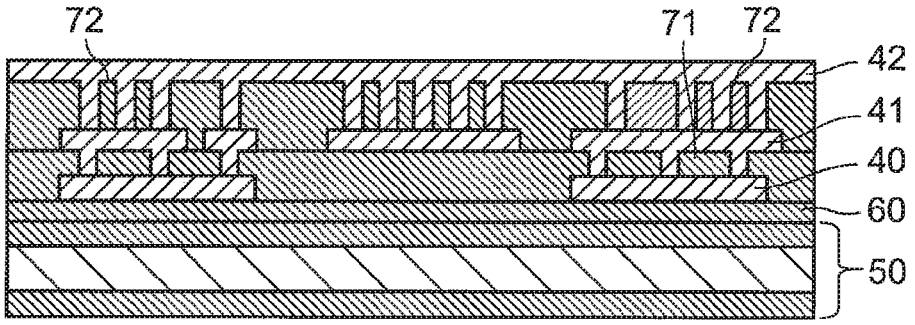
FIG. 8H is an explanatory view for explaining the manufacturing method of the example of the second embodiment.

As shown in FIG. 8H, the second insulation resin 42 is laminated on the second spiral conductor 72 by a vacuum laminator and is then thermally cured.

Figure 8I:
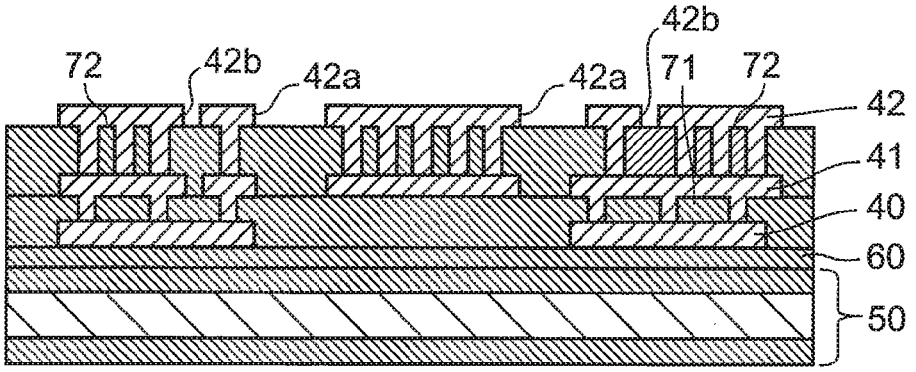
FIG. 8I is an explanatory view for explaining the manufacturing method of the example of the second embodiment.

As shown in FIG. 8I, through-holes 42*a* and a via hole 42*b* are formed in the second insulation resin 42 by laser machining. The through-holes 42*a* correspond to inner magnetic paths 312, 322. A via conductor is formed in the via hole 42*b*. By forming the through-holes 42*a* and the via hole 42*b* at the same time, a process can be simplified.

Figure 8J:
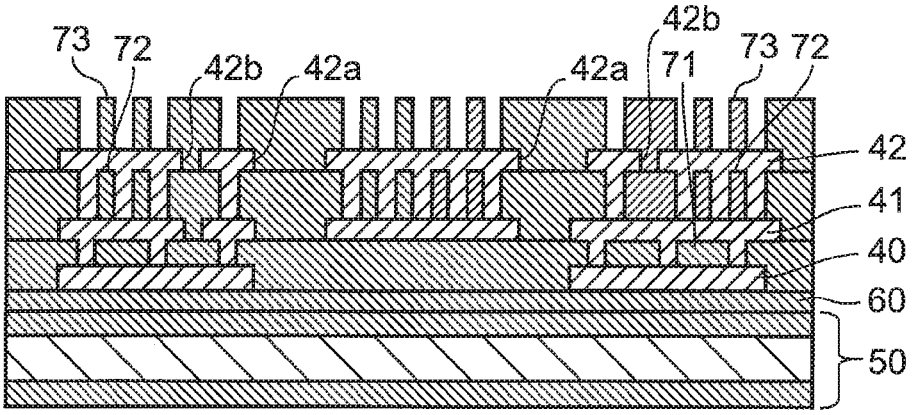
FIG. 8J is an explanatory view for explaining the manufacturing method of the example of the second embodiment.

As shown in FIG. 8J, the two third spiral conductors 73 are formed in parallel on the second insulation resin 42 by the SAP (semi additive process). In this case, one of the third spiral conductors 73 (on the left side of FIG. 8J) is connected through the via conductor to one of the second spiral conductors 72 (on the left side of FIG. 8J), and the other third spiral conductor 73 (on the right side of FIG. 8J) is connected through the via conductor to the other second spiral conductor 72 (on the right side of FIG. 8J). In this case, an excess conductor layer is formed concurrently with the third spiral conductors 73.

Figure 8K:
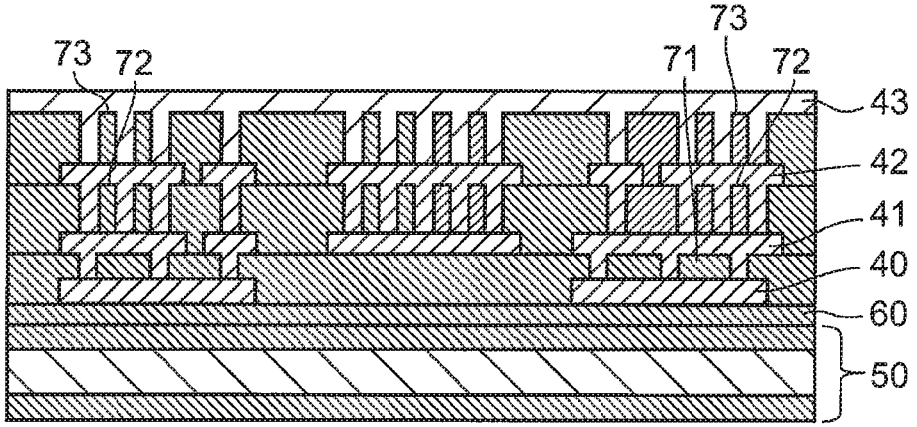
FIG. 8K is an explanatory view for explaining the manufacturing method of the example of the second embodiment.

As shown in FIG. 8K, the third insulation resin 43 is laminated on the third spiral conductor 73 by a vacuum laminator and is then thermally cured.

Figure 8L:
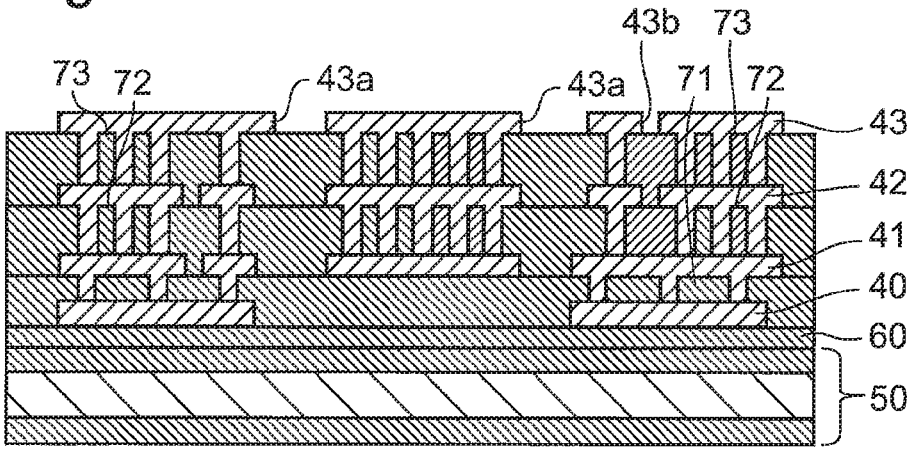
FIG. 8L is an explanatory view for explaining the manufacturing method of the example of the second embodiment.

As shown in FIG. 8L, through-holes 43*a* and a via hole 43*b* are formed in the third insulation resin 43 by laser machining. The through-holes 43*a* correspond to the inner magnetic paths 312, 322. A via conductor is formed in the via hole 43*b*. By forming the through-holes 43*a* and the via hole 43*b* at the same time, a process can be simplified.

Figure 8M:
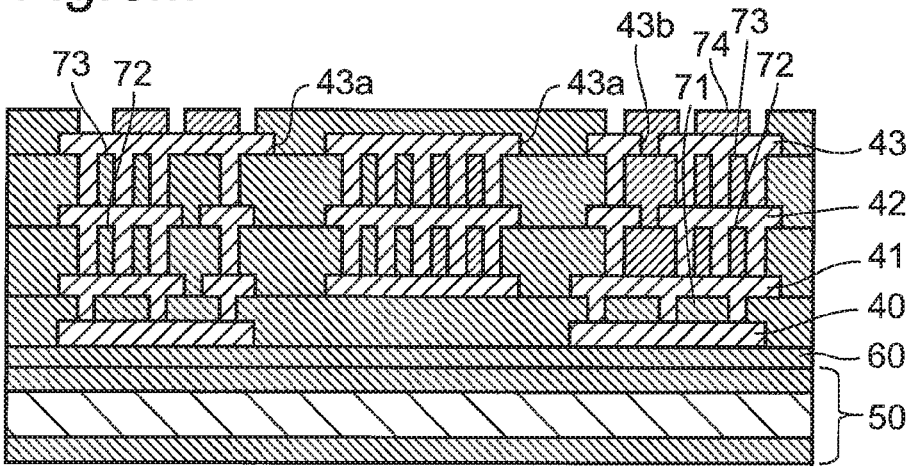
FIG. 8M is an explanatory view for explaining the manufacturing method of the example of the second embodiment.

As shown in FIG. 8M, the fourth spiral conductor 74 is formed on the third insulation resin 43 by the SAP (semi additive process). In this case, the fourth spiral conductor 74 is connected through the via conductor to the other third spiral conductor 73 (on the right side of FIG. 8M). In this case, an excess conductor layer is formed concurrently with the fourth spiral conductor 74.

Figure 8N:
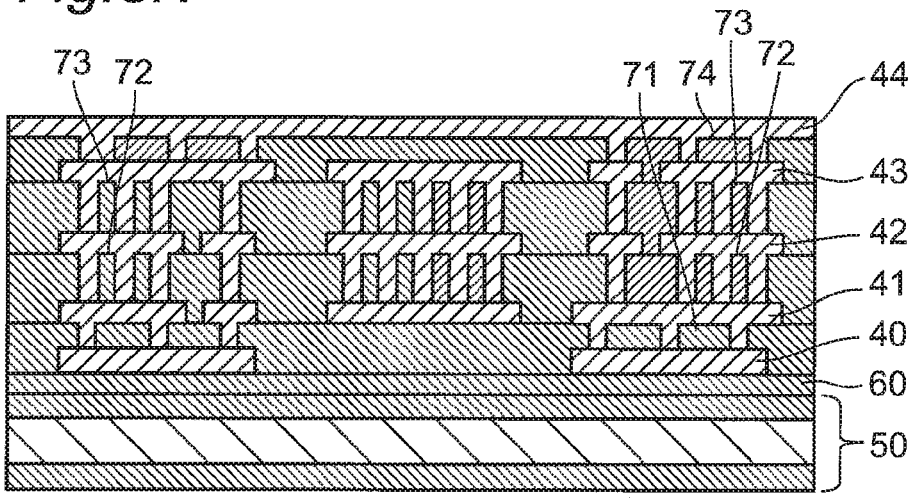
FIG. 8N is an explanatory view for explaining the manufacturing method of the example of the second embodiment.

As shown in FIG. 8N, the fourth insulation resin 44 is laminated on the fourth spiral conductor 74 by a vacuum laminator and is then thermally cured.

Figure 8O:
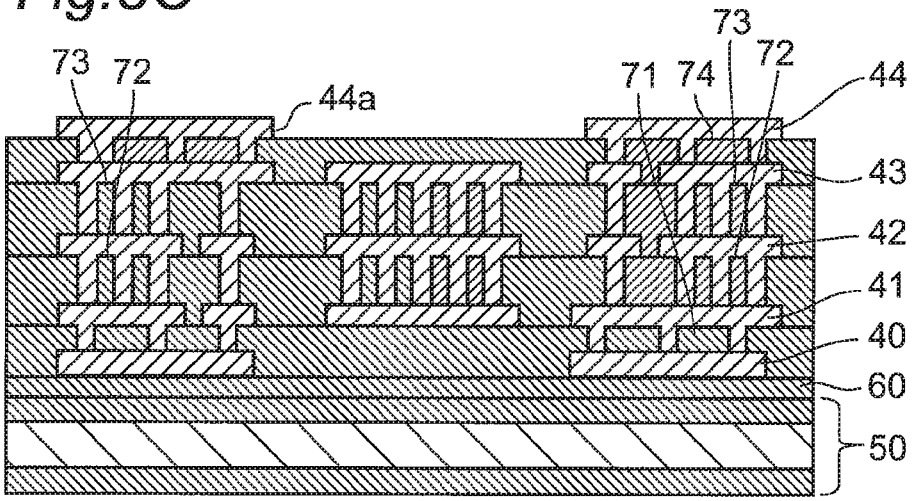
FIG. 8O is an explanatory view for explaining the manufacturing method of the example of the second embodiment.

As shown in FIG. 8O, a through-hole 44*a* is formed in the fourth insulation resin 44 by laser machining. The through-hole 44*a* corresponds to the inner magnetic path 311.

Figure 8P:
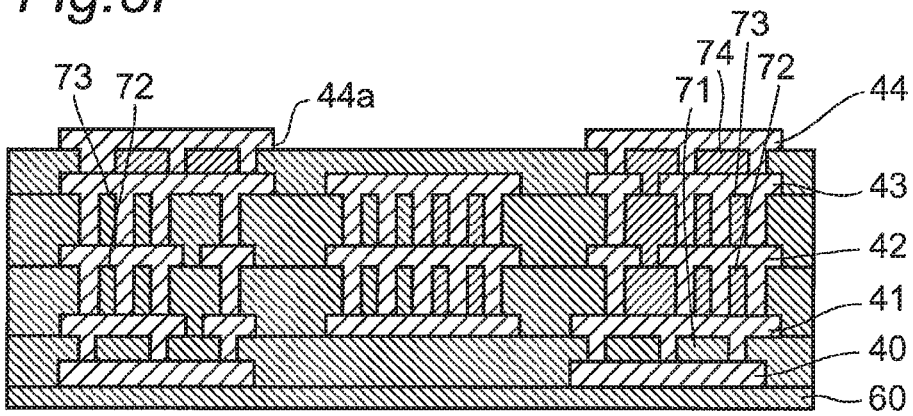
FIG. 8P is an explanatory view for explaining the manufacturing method of the example of the second embodiment.

As shown in FIG. 8P, the base 50 is peeled off from the dummy metal layer 60 on the bonding plane between one surface of the base 50 (the base metal layer 52) and the dummy metal layer 60.

Figure 8Q:
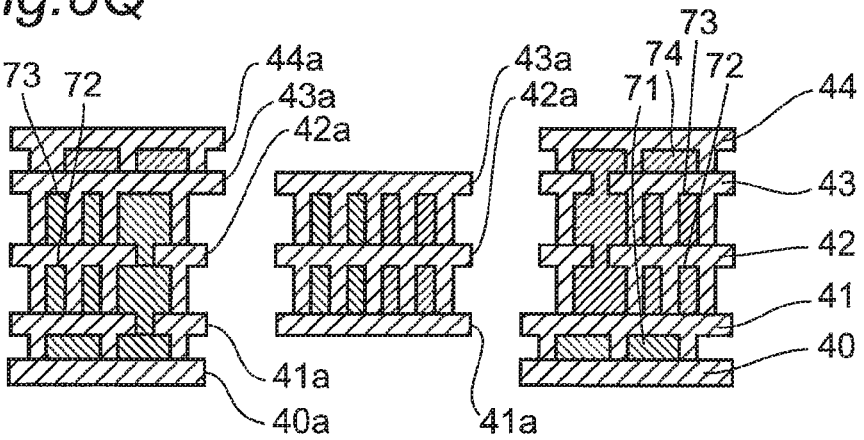
FIG. 8Q is an explanatory view for explaining the manufacturing method of the example of the second embodiment.

As shown in FIG. 8Q, the dummy metal layer 60 is removed by etching. The excess conductor layers formed along with the first to fourth spiral conductors 71 to 74 are removed by etching. As a result, spaces corresponding to the inner magnetic paths 311, 312, 321, 322 and the outer magnetic path 300 are formed. As a result, a coil laminated body is formed.

Figure 8R:
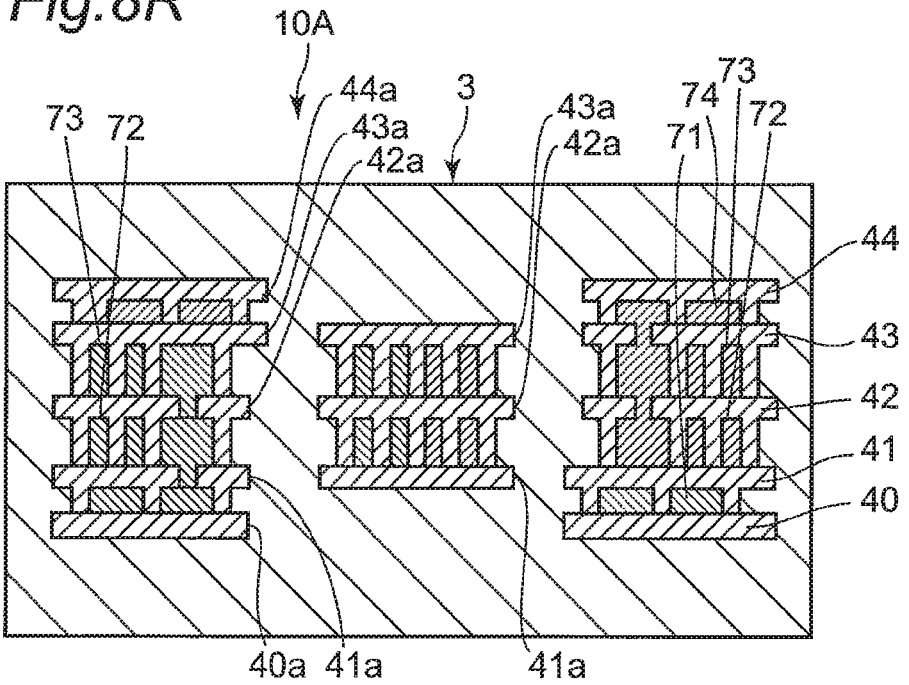
FIG. 8R is an explanatory view for explaining the manufacturing method of the example of the second embodiment.

As shown in FIG. 8R, the coil laminated body is covered with the magnetic resin making up the core 3. In this case, a plurality of sheets of the shaped magnetic resin is disposed on both sides of the coil laminated body in the lamination direction, is heated and press-bonded by a vacuum laminator or a vacuum press machine, and is subsequently subjected to cure treatment. The magnetic resin is filled into the spaces of the coil laminated body to form the inner magnetic paths 311, 312, 321, 322 and the outer magnetic path 300.

After a dicer etc. are used for cutting into individual chips, an external terminal (not shown) is connected to end portions of the first to fourth spiral conductors 71 to 74 exposed on a cut surface to form the coil component 10A.

Although the coil laminated body is formed on one of both surfaces of the base in this example, the coil laminated bodies may respectively be formed on both surfaces of the base. As a result, higher productivity can be achieved.

Although the second embodiment is described in this example, the same applies to the first and third embodiments.

The invention claimed is:

1. A coil component comprising:

a core with a closed magnetic circuit structure;

a primary-side coil wound around the core; and a secondary-side coil wound around the core, disposed in an axial direction of the primary-side coil, and magnetically coupled to the primary-side coil, wherein the primary-side coil and the secondary-side coil each include a first coil portion, and a second coil portion electrically connected to the first coil portion, wherein the second coil portion overlaps in an axial direction of the first coil portion, wherein an axis of the second coil portion is eccentric from an axis of the first coil portion, and a cross-sectional area of an inner magnetic path of the second coil portion in a direction orthogonal to the axis is smaller than a cross-sectional area of an inner magnetic path of the first coil portion in a direction orthogonal to the axis, and wherein the second coil portion of the primary-side coil and the second coil portion of the secondary-side coil are coplanar in a direction orthogonal to the axial direction of the primary-side coil.

2. The coil component according to claim 1, wherein when viewed in the axial direction of the primary-side coil, the inner magnetic path of the first coil portion of the primary-side coil overlaps with the inner magnetic path of the first coil portion of the secondary-side coil, while the inner magnetic path of the second coil portion of the primary-side coil does not overlap with the inner magnetic path of the second coil portion of the secondary-side coil.

3. The coil component according to claim 2, wherein the second coil portion of the primary-side coil and the second coil portion of the secondary-side coil are arranged in parallel in the direction orthogonal to the axis of the primary-side coil.

4. The coil component according to claim 2, wherein a cross-sectional area of a conductor of the first coil portion is different from a cross-sectional area of a conductor of the second coil portion.

5. The coil component according to claim 2, wherein a pitch of the conductor of the second coil portion is narrower than a pitch of the conductor of the first coil portion.

6. The coil component according to claim 5, wherein an aspect ratio of the conductor of the second coil portion is larger than an aspect ratio of the conductor of the first coil portion.

7. The coil component according to claim 1, wherein the core is made of an organic resin containing a magnetic material and has a magnetic permeability of 40 or less.

8. A coil component comprising:

a core with a closed magnetic circuit structure;

a primary-side coil wound around the core; and a secondary-side coil wound around the core, disposed in an axial direction of the primary-side coil, and magnetically coupled to the primary-side coil, wherein the primary-side coil and the secondary-side coil each include a first coil portion, and a second coil portion electrically connected to the first coil portion, wherein the second coil portion overlaps in an axial direction of the first coil portion, wherein an axis of the second coil portion is eccentric from an axis of the first coil portion, and a cross-sectional area of an inner magnetic path of the second coil portion in a direction orthogonal to the axis is smaller than a cross-sectional area of an inner magnetic path of the first coil portion in a direction orthogonal to the axis, and wherein when viewed in the axial direction of the primary-side coil, the inner magnetic path of the second coil portion of the primary-side coil does not overlap with the inner magnetic path of the second coil portion of the secondary-side coil.

9. The coil component according to claim 8, wherein when viewed in the axial direction of the primary-side coil, the inner magnetic path of the first coil portion of the primary-side coil overlaps with the inner magnetic path of the first coil portion of the secondary-side coil.

10. The coil component according to claim 9, wherein the second coil portion of the primary-side coil and the second coil portion of the secondary-side coil are arranged in parallel in the direction orthogonal to the axis of the primary-side coil.

11. The coil component according to claim 9, wherein a cross-sectional area of a conductor of the first coil portion is different from a cross-sectional area of a conductor of the second coil portion.

12. The coil component according to claim 9, wherein a pitch of the conductor of the second coil portion is narrower than a pitch of the conductor of the first coil portion.

13. The coil component according to claim 12, wherein an aspect ratio of the conductor of the second coil portion is larger than an aspect ratio of the conductor of the first coil portion.

14. The coil component according to claim 8, wherein the core is made of an organic resin containing a magnetic material and has a magnetic permeability of 40 or less.

* * * * *